US006802252B1

(12) United States Patent
Maggio

(10) Patent No.: US 6,802,252 B1
(45) Date of Patent: Oct. 12, 2004

(54) AUTOMATIC DEVICE FOR REPLACING PRINTING CARTRIDGES IN A GRAVURE PRINTING MACHINE

(76) Inventor: Claudio Maggio, Via E. Fermi, 8-37059 Zevio (IT)

( * ) Notice: Subject to any disclaimer, the term of this patent is extended or adjusted under 35 U.S.C. 154(b) by 0 days.

(21) Appl. No.: 10/276,450

(22) PCT Filed: May 17, 2000

(86) PCT No.: PCT/IB00/00721

§ 371 (c)(1),
(2), (4) Date: Nov. 18, 2002

(87) PCT Pub. No.: WO01/87604

PCT Pub. Date: Nov. 22, 2001

(51) Int. Cl.[7] ..... B41F 9/18
(52) U.S. Cl. ..... 101/153; 101/216; 101/DIG. 35
(58) Field of Search ..... 101/153, 216, 101/152, DIG. 35

(56) References Cited

U.S. PATENT DOCUMENTS 4,137,843 A * 2/1979 Ottenhue ..... 101/153
4,239,001 A * 12/1980 Kataoka ..... 101/152
4,502,384 A * 3/1985 Habluetzel ..... 101/153
4,887,529 A * 12/1989 Ichikawa et al. ..... 101/181
4,989,514 A 2/1991 Schiavi
5,301,611 A * 4/1994 Derivi ..... 101/486
5,347,926 A * 9/1994 Fantoni et al. ..... 101/219

FOREIGN PATENT DOCUMENTS

FR 2 563 469 10/1985

* cited by examiner

*Primary Examiner*—Daniel J. Colilla
*Assistant Examiner*—Jill E. Culler
(74) *Attorney, Agent, or Firm*—Greenberg Traurig, LLP; Charles Berman, Esq.

(57) ABSTRACT

An automatic device (10) for replacing printing cartridges to be used in cooperation with a gravure printing machine (11) comprises a plurality of printing stations, each printing cartridge including an ink tray (28) and a printing cylinder (29) and being supported by a trolley (23) that is provided with a mechanism (27) for selectively raising and/or lowering said printing cartridge to and from a working position inside of a printing station of said gravure printing machine (11). The device comprises: a series of panels (37) housed within a cavity (36) placed close to a respective printing station (13), said panels having an upper surface that is long enough for supporting at least two trolleys (23) suitable for carrying said printing cartridges; a device for displacing said panels (37) along a direction that is parallel to the longitudinal axis of said machine (11); a device for displacing said trolleys (23) in a direction that is perpendicular to said longitudinal axis of said machine, in order to carry out a reciprocating movement of the trolleys to and from the respective printing stations.

6 Claims, 4 Drawing Sheets

Section IV-IV

AUTOMATIC DEVICE FOR REPLACING PRINTING CARTRIDGES IN A GRAVURE PRINTING MACHINE

TECHNICAL FIELD

The present invention relates to an automatic device for replacing the printing cartridges in a gravure printing machine.

More particularly, the present invention relates to a device allowing the speed of replacement of the printing cartridges of a gravure printing machine to be remarkably increased, whereby said machine can rapidly be adapted in order to carry out a new printing cycle.

BACKGROUND ART

A gravure printing machine comprises a base supporting a roll from which a band made of a relatively flexible material, e.g. a plastic film, or paper, or a light cardboard, is unwound and fed to a plurality of printing stations which are serially placed in respect of said roll and finally rewound on a second roll.

Each printing station is constituted by a frame carrying a plurality of rollers, at least one of them being an impression roller that cooperates with the side surface of a printing cylinder.

The side surface of said printing cylinder is provided with a series of alphanumeric indications and/or raised shapings acting as gravure printing matrices.

In operation, the printing cylinder is partially immerged within an underlying ink tray, and it is disassembled from the printing station together with said ink tray when the printing cycle has to be changed, whereby another printing cylinder bearing different alphanumeric indications or raised shapings is then placed within the printing station in order to obtain a different printed pattern on the advancing tape.

During the printing cycle the band unwound from the first roll is successively fed to the printing rollers of the first printing station, in which the band is driven between the respective printing cylinder and impression roller, whereby a given alphanumeric indication or a graphic pattern is gravure-printed on the band by means of the ink draught from a respective ink tray.

Thereafter, the band is driven to the second printing station, wherein it is subjected to a similar printing procedure, and so on for all the printing stations; the band is finally rewound on said second roll.

Each ink tray, together with its respective printing cylinder, is normally defined as printing cartridge.

In the upper portion of each printing station there is a respective drying hood inside of which the ink that has just been deposited on the film is dried, in such a way that the film can be driven to the subsequent printing station without any risk of smears due to an ink that is on a liquid state yet.

The supporting frame for the rollers and for the printing cylinder may be shaped as a portal or provided with cantilevered elements in such a way that the respective base can easily be accessed in order to drive within the printing station a trolley suitable for supporting a respective printing cartridge.

In operation, the latter is raised on the trolley to reach a working position close to the rollers by means of a mechanical device, and it is lowered to a resting position before drawing the trolley out of its respective printing station.

This known machine involves a major drawback that is constituted by the replacement operation of all the printing cylinders that has to be carried out when the gravure printing machine has to be adapted to perform a new printing cycle.

This operation is manually carried out, and it requires the machine to be stopped for relatively long periods of time, even some hours; consequently, the costs due to the machine stop are considerably high.

DESCRIPTION OF THE INVENTION

The present invention aims to provide for an automatic device for replacing the printing cartridges of a gravure printing machine, in order to substantially reduce the cartridge replacing time.

This is achieved by means of an automatic device for replacing printing cartridges to be used in cooperation with a gravure printing machine comprising a plurality of printing stations, each printing cartridge including an ink tray and a printing cylinder and being supported by a trolley that is provided with a mechanism for selectively raising and/or lowering said printing cartridge to and from a working position inside of a each of said plurality of printing stations of said gravure printing machine, wherein the automatic device comprises: a series of panels housed within a cavity placed close to said plurality of printing stations, said panels having an upper surface that is long enough for supporting at least two trolleys suitable for carrying said printing cartridges; a device for displacing said panels along a direction that is parallel to the longitudinal axis of said machine; a device for displacing said trolleys in a direction that is perpendicular to said longitudinal axis of said machine, in order to carry out a reciprocating movement of the trolleys to and from the respective printing stations.

The dependent claims outline advantageous forms of embodiment of the automatic device according to the present invention.

The automatic device for replacing the printing cartridges of a gravure printing machine according to the present invention comprises:

- a longitudinal cavity suitable for receiving a series of panels to be placed close to a printing station, said panels being provided with a longitudinal extension able to support at least two trolleys suitable for carrying printing cartridges;
- a device for longitudinally translating said panels;
- a printing station provided with a frame fixed to a base and having a side access for inserting and removing a respective trolley;
- a device for transversally translating each trolley on guiding means;
- an unit for vertically displacing a printing cartridge, suitable for displacing said cartridge from a rest and replacement position, close to the trolley, to a working position, away from said carriage and close to a series of rollers supported by the printing station frame.

According to the invention, the upper surface of the panels is flush with the floor surface.

The device may be provided with detectors which can electrically be connected to an electronic control center that is suitable for controlling and governing both the cartridge replacement and the printing cycle operations.

While the gravure printing machine provided with the automatic device according to the invention is working according to a given printing cycle, a trolley supporting a new printing cartridge, that is provided with a new printing cylinder and a new ink tray, is placed on each panel, next to a respective printing station, said new cartridge being intended for use during a successive printing cycle.

When the printing cartridges have to be replaced, the trolleys which are present inside the printing stations are automatically removed all together, and they are placed on the upper surface of the panels. Thereafter, the panels are longitudinally displaced in such a way that each new trolley is aligned to the access opening of each printing station, and they are then inserted within the respective printing stations.

Each printing station is provided with electrical and pneumatical connectors suitable for feeding the devices which are present on each trolley. When arriving at the end of their run inside the printing station, each trolley is then automatically connected to said electrical and pneumatical connectors, so that it can immediately be operated.

Meanwhile, the trolley which are present on the panels are manually or automatically removed therefrom and they are driven to suitable washing stations.

Therefore, the replacement operation is carried out in an automatic way.

Each printing station is simultaneously fed with a fresh printing cartridge, thereby reducing the machine stop times, incresasing the productivity and reducing the working costs.

ILLUSTRATION OF DRAWINGS

Other features and advantages of the invention will become apparent by reading the following description of a form of embodiment of the invention, given as a non-limiting example, with the help of the figures illustrated in the attached sheets, in which.

DESCRIPTION OF A FORM OF EMBODIMENT

Figure 1:
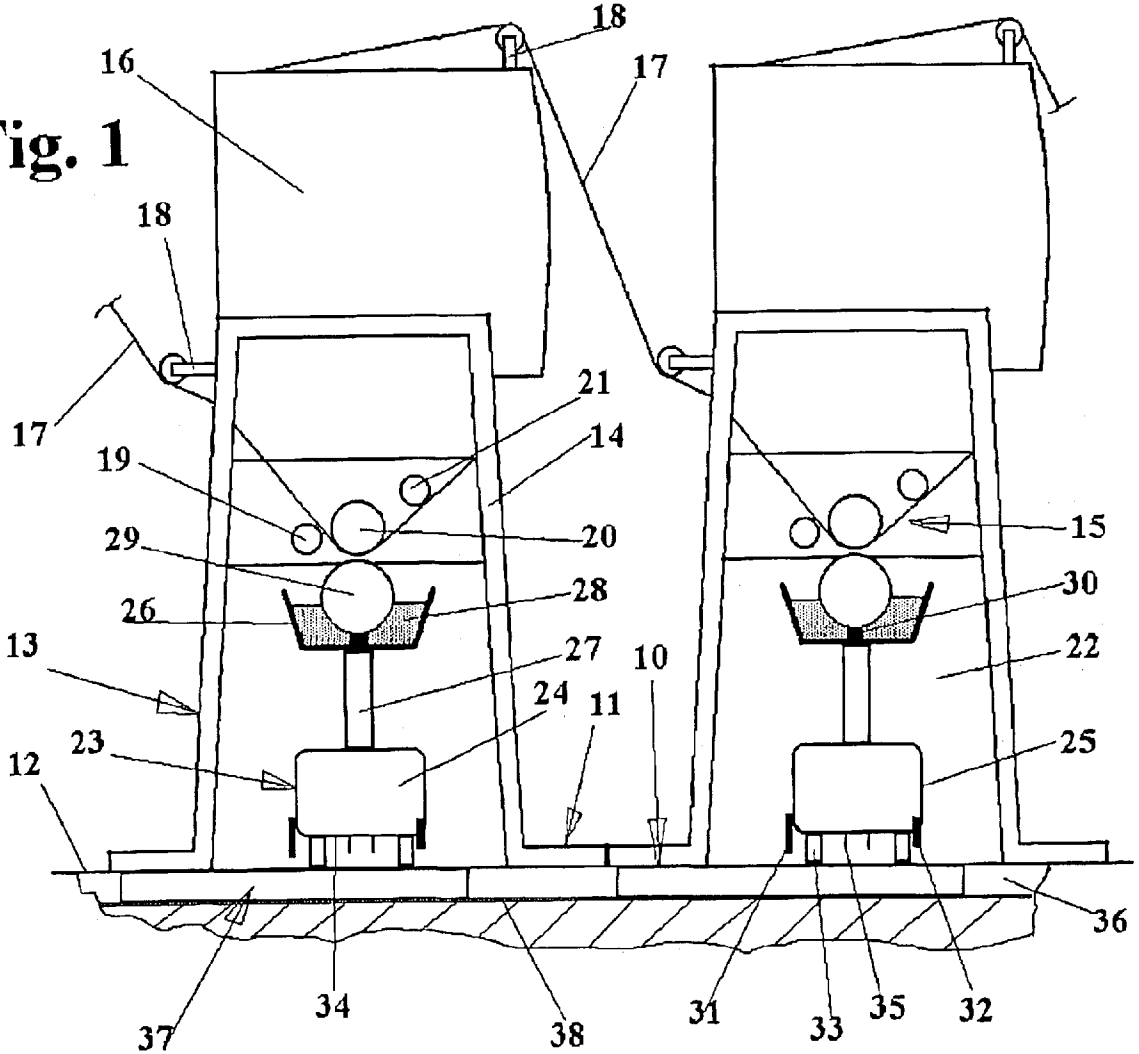
FIG. 1 is a schematic, partially sectioned, side view of a gravure printing machine provided with a device for replacing the printing cartridges according to the present invention.
Figure 2:
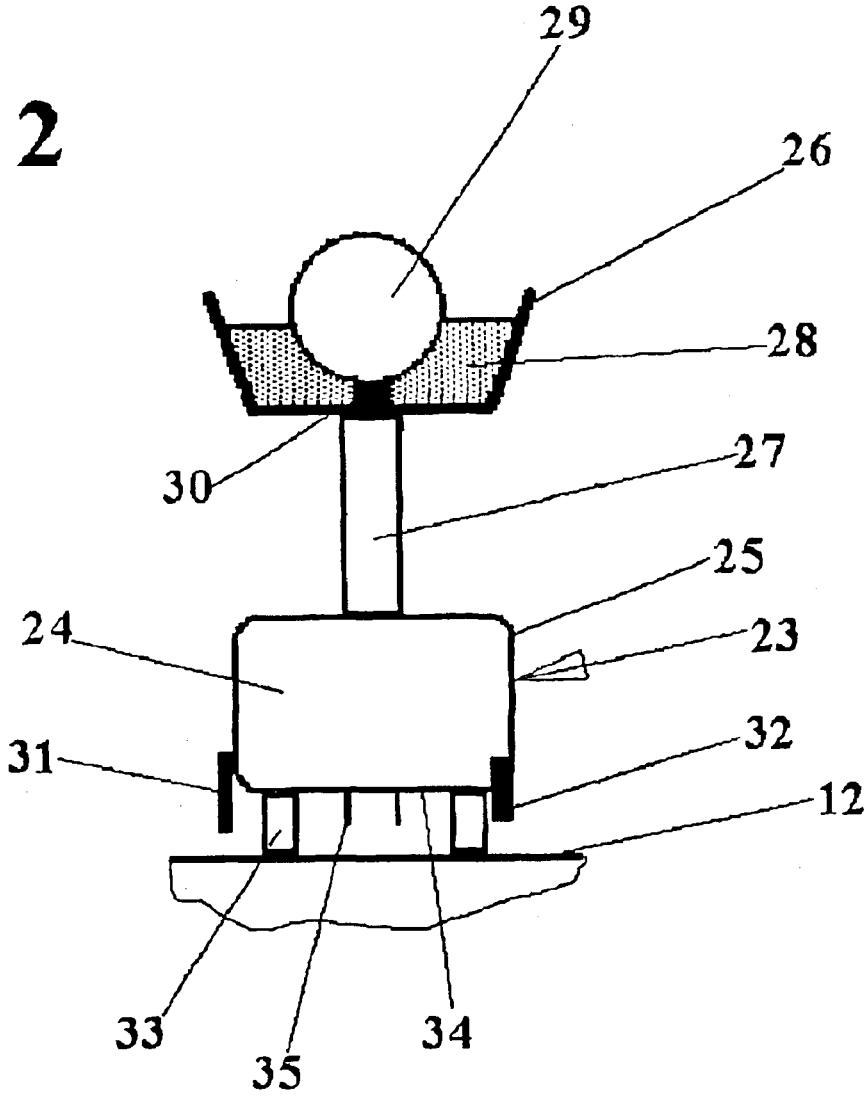
FIG. 2 shows a schematic side view, on an enlarged scale, of a trolley.

In the figures, reference sign 10 generally indicates an automatic device for replacing printing cartridges suitable for being used in cooperation with a gravure printing machine 11.

Machine 11 comprises a base 12 which a plurality of printing stations 13 are fixed to. Said printing stations are serially positioned along the longitudinal axis of gravure printing machine 11.

Each printing station 13 comprises a frame 14 that is fixed to base 12 by means of any suitable mechanical means, and that supports a series of rollers 15 and a drying hood 16 overhanging frame 14.

At a first end thereof, machine 11 is provided with a first roll (not shown in the drawings) suitable for unwinding a band 17 made of a relatively flexible material, that is made to pass through each station 13 and that is then rewound on a second roll (not shown in the drawings).

Band 17 is guided by tensioning rollers 18 which are fixed to each frame 14 and, inside of each station 13, band 17 is fed to the series of rollers 15 which may comprise an input roller 19, an impression roller 20 and an output roller 21.

Frame 14 is shaped as a portal, in such a way as to delimit an internal volume 22 that can easily be accessed to from a direction at right angles in respect of the longitudinal axis of the machine.

Said volume 22 is suitable for receiving a trolley 23. Said trolley 23 comprises an axle 24 housed within a crankcase 25 that contains an unit for displacing a tray 26 from a first position, close to said trolley 23, to a second position that, in operation, is close to the series of rollers 15.

Tray 26 may be fastened to a cylinder 27 protruding from crankcase 25 and which may be operated by any suitable mechanical device such as, for instance, a wormscrew mechanism or the like.

Tray 26 is suitable for containing an ink 28 inside of which a printing cylinder 29, supported by an element 30, is partially immerged.

The side surface of printing cylinder 29 bears raised shapings and or alphanumeric indications to be printed on band 17.

In operation, band 17 is fed between impression roller 20 and printing cylinder 29, which draws ink 28 from tray 29 and gravure prints said band 17.

The latter is then fed to the upper portion of printing station 13, where it is dried inside of drying hood 16. Band 17 is then fed to the subsequent printing station 13.

As it may be observed in FIG. 1, axle 24 of trolley 23 is provided with a side hook 31 for driving said trolley along a longitudinal direction relative to printing machine 11, as well as with a front hook 32 suitable for being caught in order to drive the trolley along a transversal direction.

The means (not shown in the figures) for gripping hooks 31 and 32 are automatically operated and are constituted by mechanical arms which protrude from respective supporting frames.

The displacement of said arms is governed by an electronic control unit that controls the overall operation of gravure printing machine 11.

Axle 24 us provided with casters 33; moreover is lower surface 34 that faces base 12 has a guide which, in operation extends in a direction at right angles in respect of the longitudinal axis of machine 11; according to this form of embodiment, said guide is constituted by a pair of listels 35, protruding from the bottom side 34 of the axle 24. 26 and cylinder 29 build up, a so-called printing cartridge, that needs to be replaced when the printing cycle of the machine has to be changed.

This replacement operation involves all printing stations 13, and it is automatized thanks to the sinchronized and automatic displacement of each trolley 23.

Figure 3:
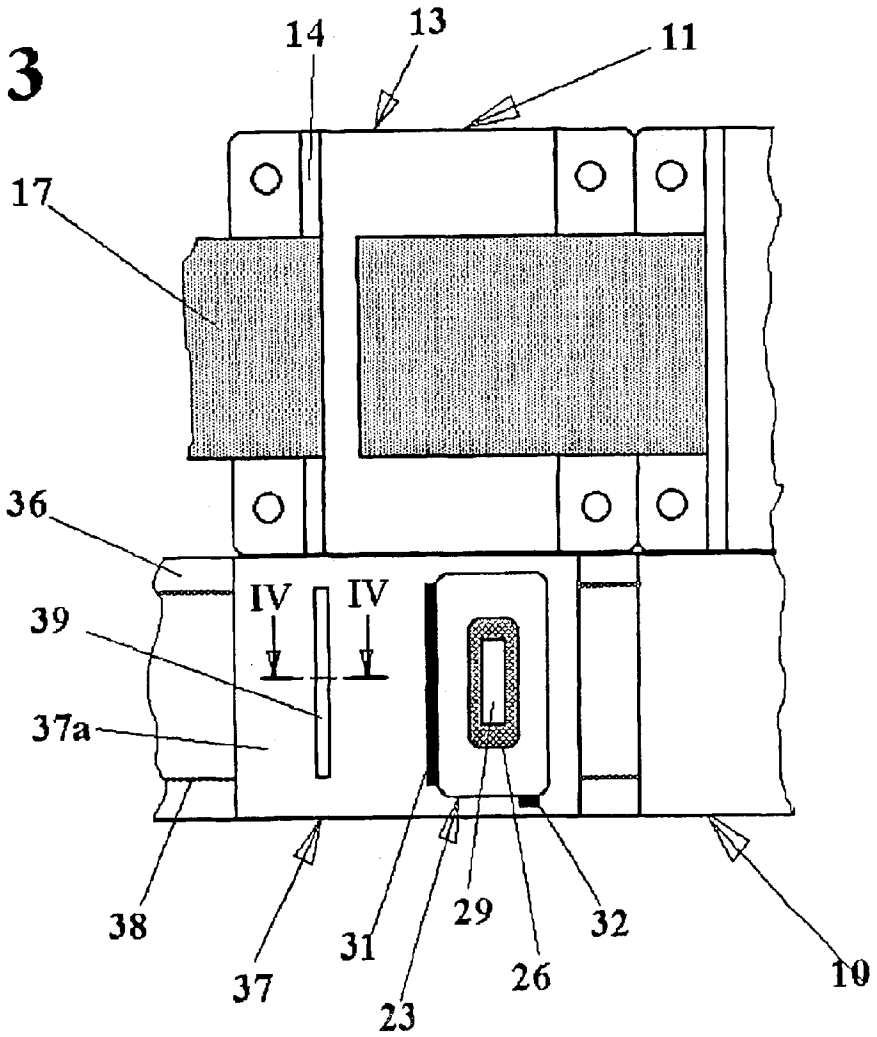
FIG. 3 shows a schematic plan view of FIG. 1.

Referring now to FIG. 3, it can be observed that automatic device 10 comprises a longitudinal cavity 36 receiving a series of panels 37 which are placed close to a respective printing station 13.

Each panel 37 is long enough for supporting at least two trolleys 23, one of them supporting a fresh cartridge and the other an exhausted one.

Panels 37 are cinematically serially connected through any suitable driving means, i.e. a chain 38 connected to a suitable motor.

In this way, each panel 37 firstly receives a trolley 23 coming from a respective printing station 13, then it is driven along a short rectilinear path within cavity 36 in order to align a second trolley 23, that supports a fresh cartridge, to the opening of frame portal 14.

A mechanical device for displacing the trolley sideways, is constituted by mechanical cantilevered arms suitable for gripping hook 32, and it allows trolley 23 to be driven to and from a respective printing station 13.

A possible second mechanical device for displacing the trolley in a longitudinal direction relative to the axis of the printing machine allows the trolleys to be driven to and from panels 37.

The upper surface 37*a* of each panel 37 is provided with transversal slits 39 which are substantially parallel to each other; the number of said slits 39 is equal to the one of the trolleys to be driven.

Figure 4:
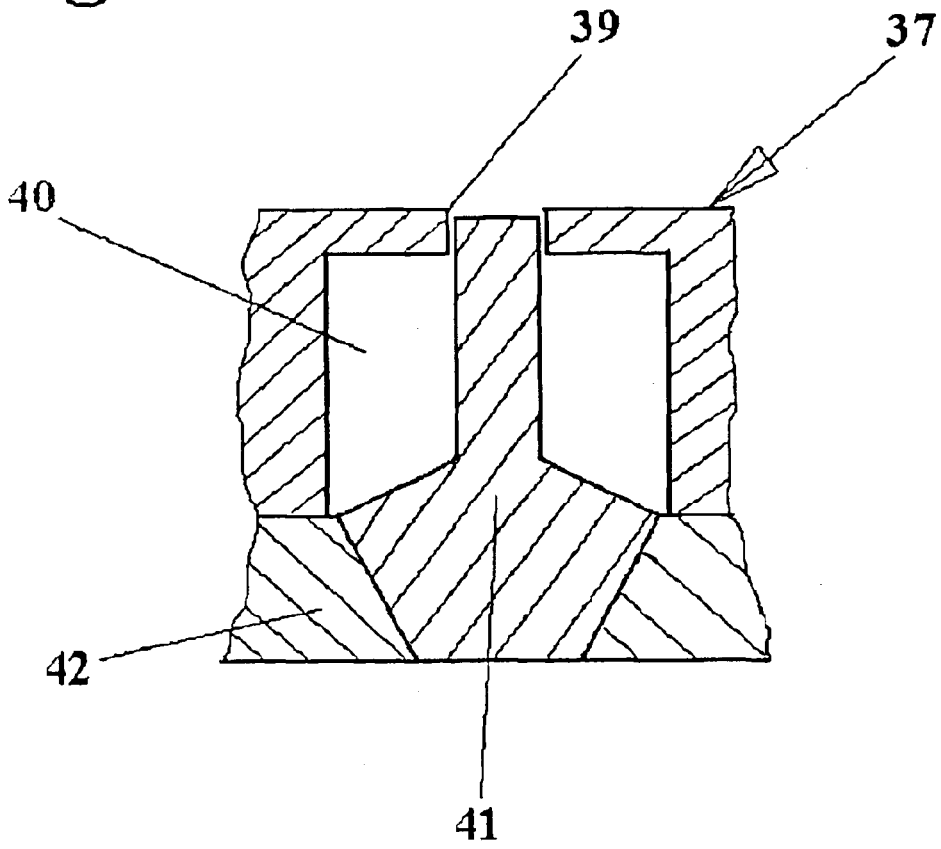
FIG. 4 shows a schematical section view, on an enlarged scale, taken along line IV—IV of FIG. 3.

Referring now to FIG. 4, it may be observed that beneath of each slit 39 there is a rail 41 that is contained within a chamber 40. Said rail may be displaced in a vertical direction by means of a suitable mechanism (i.e. the simple mechanism 42 in the figures).

In operation, rail 41 protrudes from respective panel 37 and is inserted between the guiding listels 35, thereby enabling the transversal movement of a trolley 23.

When a trolley has to be released from panel 37, rail 41 is lowered under slits 39, thereby allowing trolley 23 to be longitudinally displaced.

Advantageously, the upper surface 37*a* of each panel 37 is flush with the floor surface in order to allow an easy displacement of the trolleys.

The procedure for automatically replacing a series of printing cartridges comprises the following subsequent steps:

- preparing a fresh replacing cartridge on a respective trolley 23 and positioning the latter on a respective panel 37;
- lowering the cartridge that is being used on its respective trolley inside of the printing station;
- removing from the printing stations each trolley that carries an exhausted cartridge and placing these trolleys on the free spaces of panels 37;
- operating the panel displacing device in order to bring the newly loaded trolleys in alignment with the access apertures of the printing stations;
- inserting the latter trolleys inside of the printing stations;
- raising the printing cartridges until they reach their working position;
- removing the trolleys carrying the exhausted cartridges from the panels and driving them to respective washing stations.

The invention has been described with reference to a particular form of embodiment thereof. However, it is clear that the invention includes several variants falling within its scope, in the range of mechanical equivalences.

In this context, it is particularly clear that the invention includes all kind of different driving means both for transversally displacing the trolleys, and for longitudinally displacing the panels.

What is claimed is:

1. Automatic device for replacing printing cartridges to be used in cooperation with a gravure printing machine comprising a plurality of printing stations, each printing cartridge including an ink tray and a printing cylinder and being supported by a trolley that is provided with a mechanism for selectively raising and/or lowering said printing cartridge to and from a working position inside of each of said plurality of printing stations of said gravure printing machine, wherein the automatic device comprises:

- a series of panels housed within a cavity placed close to said plurality of printing stations, said panels having an upper surface that is long enough for supporting at least two trolleys suitable for carrying said printing cartridges;
- a device for displacing said panels along a direction that is parallel to the longitudinal axis of said machine;
- a device for displacing said trolleys in a direction that is perpendicular to said longitudinal axis of said machine, in order to carry out a reciprocating movement of the trolleys to and from the respective printing stations.

2. Device according to claim 1, wherein each of said plurality of printing stations has a frame defining a side access opening for allowing the respective insertion and removal of a trolley.

3. Device according to claim 1, wherein each trolley is provided with first guiding means cooperating with means for raising said trolley over the surface of a respective panel.

4. Device according to claim 3, wherein said means for raising the trolley are constituted by a rail protruding from a slit provided on said panel, whereby said rail can be lowered beneath the upper surface of said panel.

5. Device according to claim 1, wherein the upper surface of said panels is flush with the floor on which the machine is placed.

6. Device according to claim 1, wherein each trolley is provided with a front hook and a side hook suitable for being gripped by suitable driving means in order to displace the trolley along two perpendicular directions.

* * * * *